US009080496B2

(12) United States Patent
Demots et al.

(10) Patent No.: US 9,080,496 B2
(45) Date of Patent: Jul. 14, 2015

(54) EXHAUST MANIFOLD FOR AN ENGINE AND METHOD FOR MANUFACTURE

(75) Inventors: Anthony Bernard Demots, London (GB); Robert Andrew Wade, Dearborn, MI (US); Steven Johnson, Brentwood (GB); Michael John Cade, Welwyn Garden (GB)

(73) Assignee: Ford Global Technologies, LLC, Dearborn, MI (US)

( * ) Notice: Subject to any disclaimer, the term of this patent is extended or adjusted under 35 U.S.C. 154(b) by 196 days.

(21) Appl. No.: 13/605,881

(22) Filed: Sep. 6, 2012

(65) Prior Publication Data

US 2013/0061586 A1 Mar. 14, 2013

(30) Foreign Application Priority Data

Sep. 13, 2011 (GB) ..... 1115819.3

(51) Int. Cl.
*F01N 1/00* (2006.01)
*F01N 13/18* (2010.01)

(52) U.S. Cl.
CPC ..... *F01N 13/1811* (2013.01); *F01N 13/1861* (2013.01); *Y10T 29/49398* (2015.01)

(58) Field of Classification Search
USPC ..... 60/272, 322, 323, 324; 277/591–594
See application file for complete search history.

(56) References Cited

U.S. PATENT DOCUMENTS 4,689,952 A * 9/1987 Arthur et al. ..... 60/313
5,159,811 A * 11/1992 Hefler et al. ..... 60/322
5,572,867 A * 11/1996 Bekkering et al. ..... 60/305
6,155,045 A * 12/2000 Durr et al. ..... 60/323
7,926,852 B2 4/2011 Geminn
8,661,802 B2 * 3/2014 Riekers et al. ..... 60/323
2011/0016859 A1 * 1/2011 Schumnig ..... 60/323

FOREIGN PATENT DOCUMENTS

DE 10063474 A1 7/2002
DE 102008048484 A1 4/2010
FR 2924643 A1 6/2009
JP 7247836 * 9/1995 ..... 60/323
JP 7247836 A 9/1995
JP 8128321 A 5/1996
JP 9324625 A 12/1997

OTHER PUBLICATIONS

"My 83 300 D," http://www.superturbodiesel.com/std/thread-1857-post-20282.html, Accessed Feb. 13, 2013, Posted Oct. 15, 2010, 2 pages.

* cited by examiner

*Primary Examiner* — Binh Q Tran

(74) *Attorney, Agent, or Firm* — Julia Voutyras; Alleman Hall McCoy Russell & Tuttle LLP

(57) ABSTRACT

A cast exhaust manifold for an engine is disclosed that is fastened to the engine by a number of independent flanges between each pair of which a spacer is positioned to produce an interference fit when the exhaust manifold is at ambient temperature. The use of independent flanges allow the exhaust manifold to expand when heated without creating high levels of internal stress and the spacers prevent undue distortion of the exhaust manifold when the exhaust manifold cools.

12 Claims, 9 Drawing Sheets

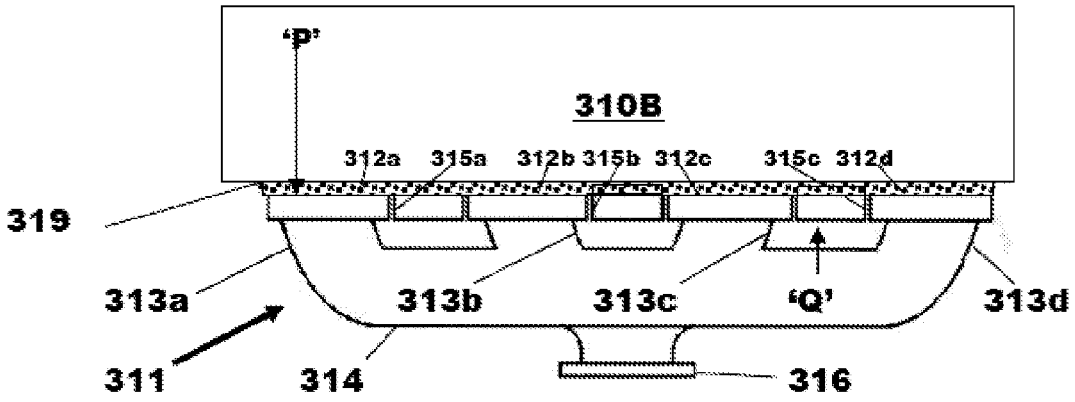
Fig.5A
Fig.5B
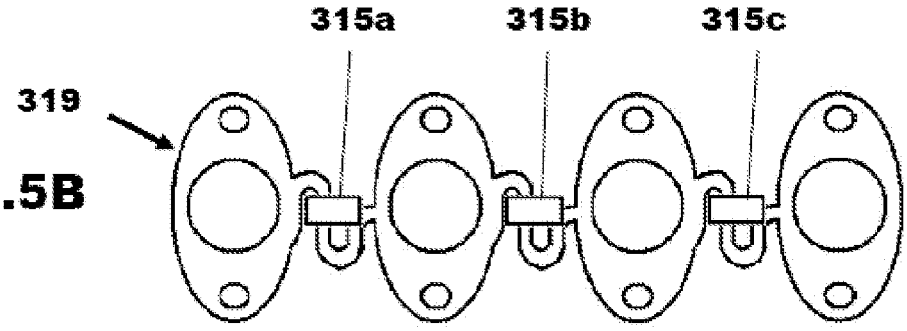
Fig.5C
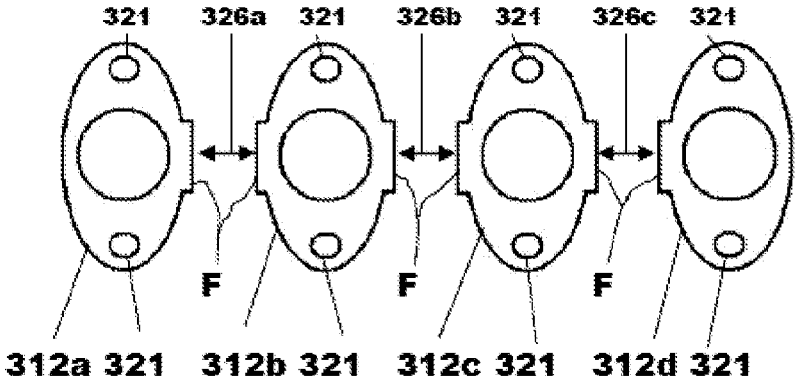

EXHAUST MANIFOLD FOR AN ENGINE AND METHOD FOR MANUFACTURE

CROSS-REFERENCE TO RELATED APPLICATIONS

This application claims priority to United Kingdom application number 1115819.3 filed on Sep. 13, 2011, the entire contents of which are hereby incorporated herein by reference for all purposes.

FIELD

The present invention relates to internal combustion engines and in particular to an exhaust manifold for an internal combustion engine.

BACKGROUND/SUMMARY

Exhaust manifolds operate in a high temperature environment (e.g., in an environment with temperatures around or greater than 1000° C.) which may approach the operating limits of the material from which it is constructed. Such materials include austenitic and ferritic cast iron and austenitic and ferritic cast stainless steel. Specifically, exhaust manifolds may be cast out of these materials. Over the life of an engine an exhaust manifold may heat up and cool down many times, which may cause distortion. During a hot phase, an exhaust manifold may expand up to 3 mm in length, for example. When it cools down, however, the manifold may contracts (e.g., permanently contract) such that after many thermal cycles it is 3 mm shorter in length when compared to its original length, for example.

FIG. 8 shows a prior art exhaust manifold 411. The exhaust manifold 411 shown in FIG. 8 is provided with a single flange 412 to connect the manifold 411 to a cylinder head (not shown) of an engine (not shown). However, the use of such a single flange increases the internal stress during the hot cycle, because the single flange restricts expansion of the manifold as the manifold cools. This distortion may cause excessive internal stress and ultimately breakage of the manifold resulting in exhaust gas leakage. Hence, the prior art manifold shown in FIG. 8 is more likely to crack as indicated by the arrow 'C' on FIG. 8.

Attempts have been made to reduce the risk of such cracking. For example, the prior art shown in FIG. 9A illustrates an exhaust manifold 511 that uses separate flanges 512 to connect the exhaust manifold 511 to a cylinder head (not shown) of an engine (not shown).

However, as shown in FIG. 9B (prior art) when the exhaust manifold 511 is heated and subsequently cools down it may to bend due to plastic deformation. This can cause the manifold 511 to crack, or to curve and pull away from the cylinder head. This pull-away can cause leakage from the joint or it can cause any fasteners holding the exhaust manifold 511 to the cylinder head to snap off resulting in further leakage.

Therefore, an improved exhaust manifold that overcomes or reduces (e.g., minimizes) the stress and distortion mention above is described herein. As such in one example, an exhaust manifold for an engine is provided. The exhaust manifold comprises a cast body defining at least two exhaust gas transfer tubes and a common exhaust gas outlet, each of the exhaust gas transfer tubes having a respective flange for securing the exhaust manifold in use to the engine where a spacer is fitted between adjacent flanges producing an interference fit with the adjacent flanges when the exhaust manifold is cold, for example cooled to ambient temperatures.

When a spacer is used to produce an interference fit, the likelihood of thermal degradation (e.g., warping) of the exhaust manifold is reduced when compared to prior art exhaust manifolds. As a result, the likelihood of manifold leaks is decreased and the longevity of the exhaust manifold and therefore the engine is increased.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE FIGURES

FIG. 5A is a plan view of a third example exhaust manifold in a hot condition;

FIG. 5B is a view in the direction of arrow 'Q' on FIG. 5A of a gasket with spacers fitted prior to assembly;

FIG. 5C is a view in the direction of arrow 'p' on FIG. 5A of four flanges of the exhaust manifold prior to insertion of the spacers shown in FIG. 5B;

DETAILED DESCRIPTION

An exhaust manifold with reduced susceptibility to thermal degradation is described herein. The exhaust manifold may include a cast body defining at least two exhaust gas transfer tubes and a common exhaust gas outlet, each of the exhaust gas transfer tubes having a respective flange for securing the exhaust manifold in use to the engine where a spacer is fitted between adjacent flanges producing an interference fit with the adjacent flanges when the exhaust manifold is cold.

In some examples, each spacer may be held captive (e.g., substantially fixed) in position between the adjacent flanges. Further in some examples, each of the flanges may have a mating surface for sealing attachment to the engine and each of the mating surfaces has part of a recess formed in it into which the spacer is fitted so as to hold the spacer captive.

In some examples, a gap may be defined between adjacent flanges and each spacer may be held captive so as to project into the gap defined between adjacent flanges.

Further in some examples, each of the flanges may have a mating surface for sealing attachment to the engine, a gasket may be interposed between each mating surface and the engine and each spacer may be attached to the gasket so as to hold the spacer captive.

In another example, the aforementioned exhaust manifold is included in an internal combustion engine having a cylinder head, the exhaust manifold may be sealingly secured to the cylinder head for transferring exhaust gases from the engine to an exhaust system.

Still further in another example, the exhaust manifold is included in a motor vehicle, the motor vehicle may have an exhaust system connected to an outlet from the exhaust manifold to transport exhaust gasses from the engine to atmosphere.

A method for manufacturing of an exhaust manifold is also disclosed. The method may include casting a manifold body defining at least two exhaust gas transfer tubes and a common exhaust gas outlet, allowing the manifold body to cool to a desired (e.g., ambient) temperature, forming to predetermined dimensions a space between adjacent exhaust gas transfer tubes, producing to predetermined dimensions a number of spacers for fitment to the spaces and fitting a respective spacer into each of the spaces to produce an interference fit between the spacers and the flanges when the exhaust manifold is cold.

In some examples, each of the exhaust gas transfer tubes may have a respective flange for securing the exhaust manifold to the engine and each space is formed partly in each of the individual flanges of adjacent exhaust gas transfer tubes. Additionally in some examples, the individual flanges may be formed as part of the casting process.

Alternatively, the individual flanges may be formed by casting a single flange as part of the manifold body and machining gaps in the single flange between adjacent exhaust gas transfer tubes to produce the individual flanges.

Figure 1:
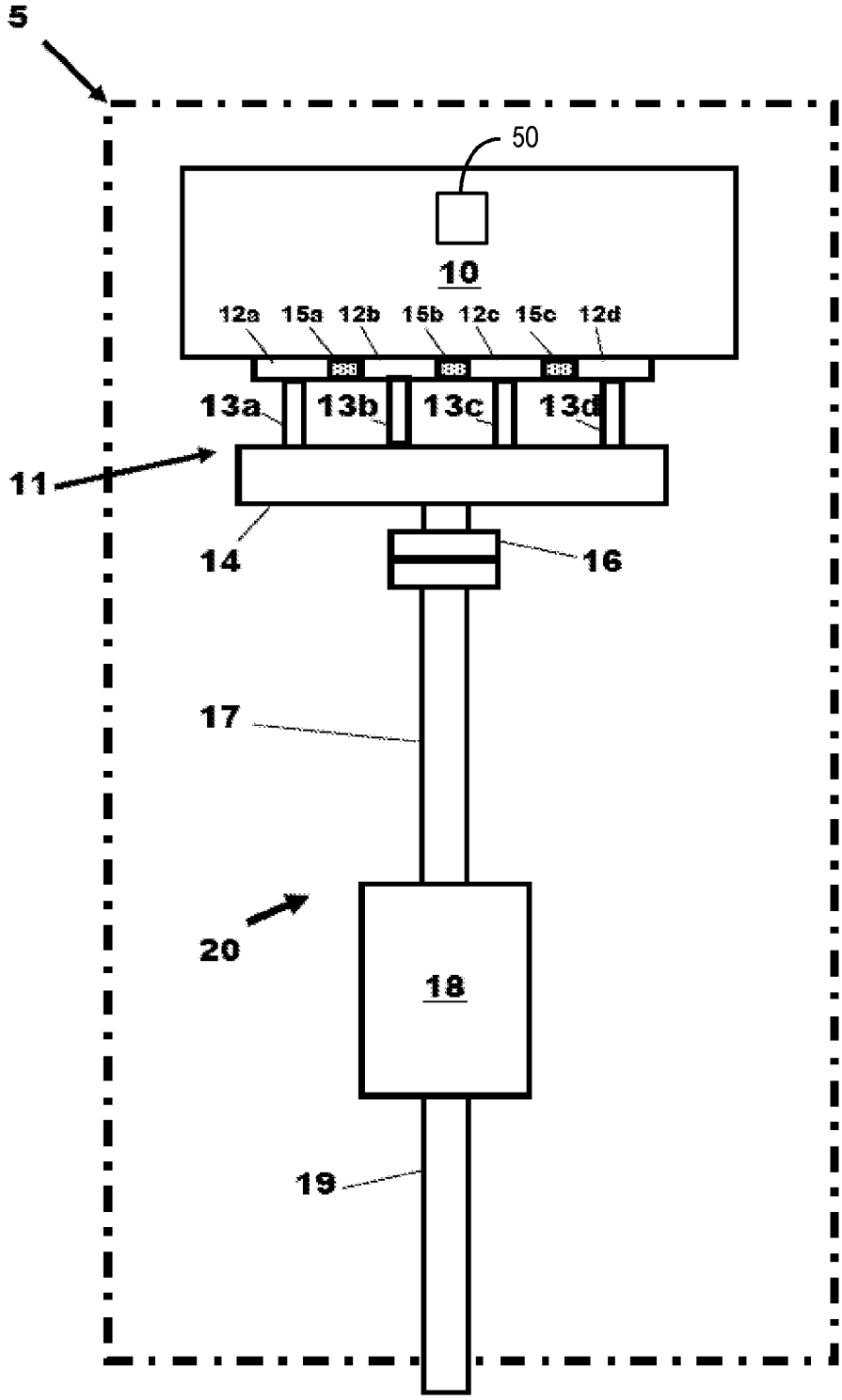
FIG. 1 is a schematic representation of a motor vehicle having an engine and an exhaust manifold.

With particular reference to FIG. 1 there is shown a motor vehicle 5 having an engine 10. The engine 10 has an exhaust manifold 11 fastened thereto to transfer exhaust gasses from the engine 10 to an exhaust system 20. The engine 10 may include one or more cylinders 50. In the depicted example, the engine may include four cylinders in fluidic communication with transfer tubes 13*a*, 13*b*, 13*c* and 13*d*, respectively. However, in other examples, each cylinder may have two or more transfer tube coupled thereto and the number of engine cylinders may be adjusted. For example, the engine may include 2 cylinder, 6 cylinders, etc., and each cylinder may have two transfer tube connected thereto.

The exhaust system 20 includes an exhaust pipe 17 connected at one end to a common exhaust gas outlet 16 from the exhaust manifold 11, one or more noise and/or emission control devices 18 and a tail pipe 19 from which exhaust gasses flow to atmosphere.

The exhaust manifold 11 includes a cast body defining four exhaust gas transfer tubes 13*a*, 13*b*, 13*c* and 13*d*, the common exhaust gas outlet 16 and a collection means such as a chamber 14 where the exhaust gases from all of the exhaust gas transfer tubes 13*a*, 13*b*, 13*c* and 13*d* are combined or merged so as to flow out through the common exhaust gas outlet 16. In the example shown all of the exhaust gasses from the engine 10 flow out via a single exhaust manifold 11 but it will be appreciated that more than one exhaust manifold could be used on the same engine.

It will be further appreciated that the exhaust manifold 11 could be used to supply exhaust gas to a turbocharger. Each of the exhaust gas transfer tubes 13*a*, 13*b*, 13*c* and 13*d* has a respective flange 12*a*, 12*b*, 12*c* and 12*d* for securing the exhaust manifold 11 in use to the engine 10 by threaded fasteners (not shown).

A spacer 15*a*, 15*b* and 15*c* is fitted between adjacent flanges 12*a*, 12*b*, 12*c* and 12*d* so as to produce an interference fit with the adjacent flanges 12*a*, 12*b*, 12*c* and 12*d* when the exhaust manifold 11 is cold. That is to say, the spacer 15*a* is fitted between the flanges 12*a* and 12*b*; the spacer 15*b* is fitted between the flanges 12*b* and 12*c*; and the spacer 15*c* is fitted between the flanges 12*c* and 12*d*.

It will be appreciated that depending on the mutual position of tolerance zones of the coupled parts, three types of fit can be distinguished:

A. Clearance Fit

Is a fit that always enables a clearance between the female part (hole or recess) and male part. The lower limit size of the hole is greater or at least equal to the upper limit size of the male part.

B. Transition Fit

Is a fit where, depending on the actual sizes of the female and male parts, both clearance and interference may occur. Tolerance zones of the female and male parts partly or completely overlap.

C. Interference Fit

Is a fit always ensuring some interference between the female and male parts. The upper limit size of the female part is smaller or at least equal to the lower limit size of the male part.

Therefore the term 'interference fit' as meant herein means a fit where the width or diameter of the respective spacer 15*a*, 15*b* and 15*c* is greater than the space or gap between the flanges 12*a*, 12*b*; 12*b*, 12*c*; 12*c*, 12*d* in which it is fitted. In one non-limiting example an interference of 0.028 mm was used but it will be appreciated that other interference fits could be used and that the interference fit can require the use of a press to push the spacer into position (press fit) or merely the application of a manual force (push fit).

The exhaust manifold 11 may be 'cold' when it is at or near ambient temperature such as for example 20° C. and is 'hot' when it has been heated by exhaust gas flow from the engine 10 to a normal running temperature such as for example and without limitation 400° C. to 1000° C.

Figure 2A:
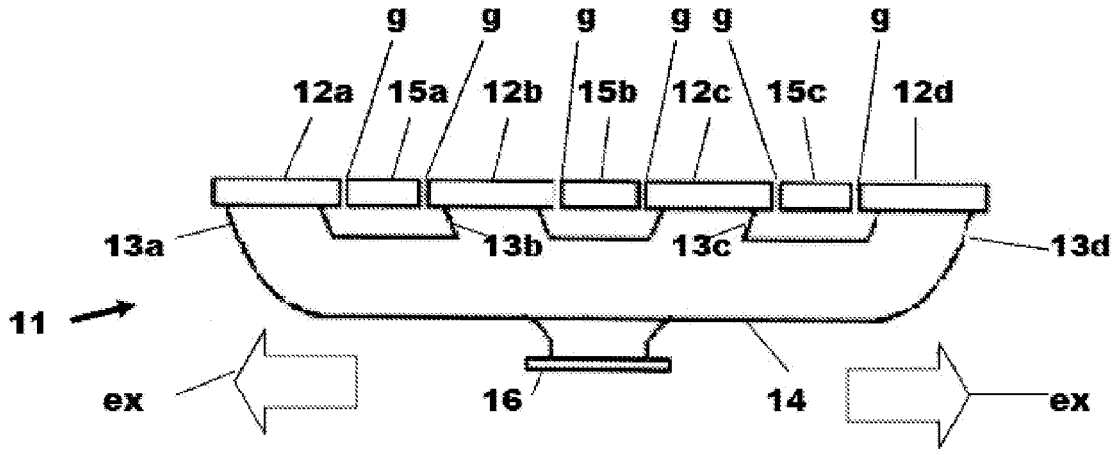
FIG. 2A is a plan view of the exhaust manifold shown schematically in FIG. 1 showing the exhaust manifold in a hot condition.
Figure 2B:
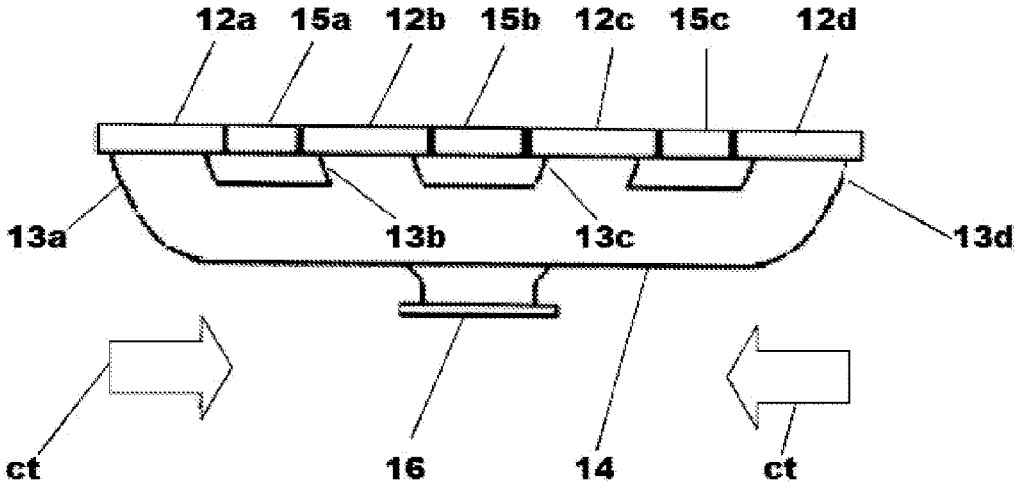
FIG. 2B is a plan view of the exhaust manifold shown schematically in FIG. 1 showing the exhaust manifold in a cold condition.

Referring now to FIGS. 2A and 2B the exhaust manifold 11 shown schematically in FIG. 1 is shown in hot and cold conditions respectively.

In the hot condition shown in FIG. 2A the exhaust manifold 11 has expanded as indicated by the arrows 'ex' and this expansion is not prevented by the spacers 15*a*, 15*b* and 15*c*. The expansion of the exhaust manifold 11 has caused gaps 'g' to open up between the spacers 15*a*, 15*b* and 15*c* and the adjacent flanges 12*a*, 12*b*; 12*b*, 12*c*; and 12*c*, 12*d*.

When the exhaust manifold 11 cools it contracts as indicated by the arrows 'ct' on FIG. 2B but because of the presence of the spacers 15*a*, 15*b* and 15*c* distortion of the exhaust manifold 11 is reduced or in some cases eliminated.

That is to say, if the flanges 12*a*, 12*b*, 12*c* and 12*d* are linked when cold with the tight fitting spacers 15*a*, 15*b* and 15*c* the stress and distortion associated with the prior art exhaust manifolds referred to above can be eliminated, if desired. This is because during the hot cycle the spacers 15*a*, 15*b* and 15*c* allow the flanges 12*a*, 12*b*; 12*b*, 12*c*; and 12*c*, 12*d* to expand away from each other. However, during a cool down cycle when the exhaust manifold 11 contracts, the spacers 15*a*, 15*b* and 15*c* prevent the flanges 12*a*, 12*b*, 12*c* and 12*d* from moving further than their original position.

Figure 3A:
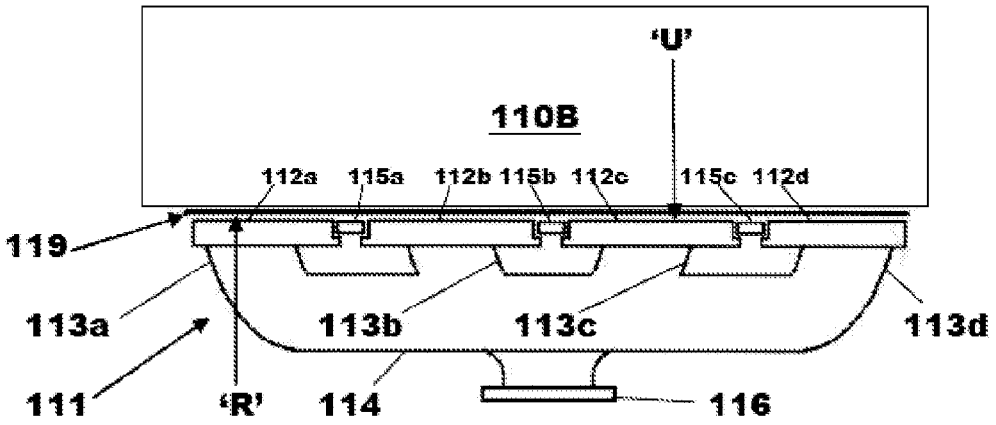
FIG. 3A is a plan view of a first example of an exhaust manifold in a hot condition.
Figure 3B:
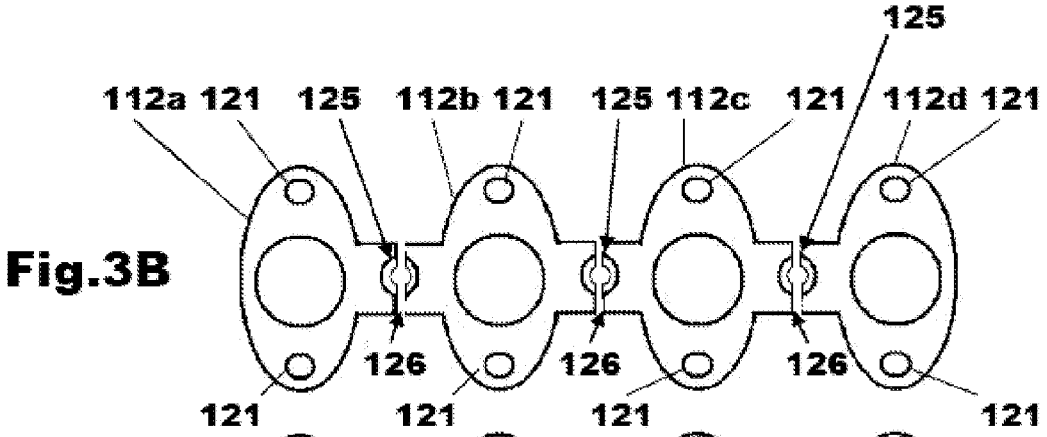
FIG. 3B is a view in the direction of arrow 'U' on FIG. 3A of the exhaust manifold in a pre-assembled state before spacers have been fitted.
Figure 3C:
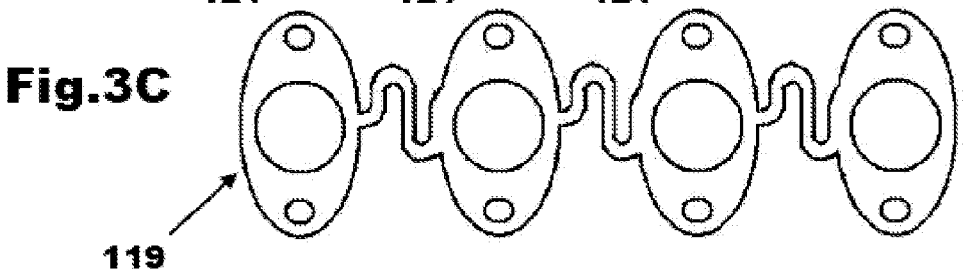
FIG. 3C is a view in the direction of arrow 'R' on FIG. 3A showing a gasket.

Referring now to FIGS. 3A to 3C there is shown a first example exhaust manifold 111. It will be appreciated that the exhaust manifold 111 may be the exhaust manifold 11, shown in FIG. 1. The exhaust manifold 111 comprises a cast body defining four exhaust gas transfer tubes 113*a*, 113*b*, 113*c* and 113*d* and a common exhaust gas outlet 116 and a collection means in the form of a chamber 114 where the exhaust gases from all of the exhaust gas transfer tubes 113*a*, 113*b*, 113*c* and 113*d* are combined or merged so as to flow out through the common exhaust gas outlet 116.

Each of the exhaust gas transfer tubes 113*a*, 113*b*, 113*c* and 113*d* has a respective flange 112*a*, 112*b*, 112*c* and 112*d* for securing the exhaust manifold 111 in use to a cylinder head 110B of an engine, such as the engine 10 shown in FIG. 1, by means of threaded fasteners (not shown) which extend through holes 121 formed in the flanges 112*a*, 112*b*, 112*c*, 112*d*. A gasket 119 is interposed between the exhaust cylinder head 110B and the flanges 112*a*, 112*b*, 112*c* and 112*d* to provide a gas tight seal. Each of the flanges 112*a*, 112*b*, 112*c* and 112*d* has a machined mating surface for co-operation with the gasket 119.

A round disc spacer 115*a*, 115*b* and 115*c* is fitted between adjacent flanges 112*a*, 112*b*, 112*c* and 112*d* so as to produce an interference fit with the adjacent flanges 112*a*, 112*b*, 112*c* and 112*d* when the exhaust manifold 111 is cold.

The spacer 115*a* is fitted in a substantially cylindrical space or recess 125 formed between the flanges 112*a* and 112*b*; the spacer 115*b* is fitted in a substantially cylindrical recess 125 formed between the flanges 112*b* and 112*c*; and the spacer 115*c* is fitted in a substantially cylindrical recess 125 between the flanges 112*c* and 112*d*. Each of the substantially cylindrical recesses 125 is machined into the mating surface of the flanges 112*a*, 112*b*, 112*c* and 112*d* and would be completely cylindrical if it were not for gaps 126 that exist between adjacent flanges 112*a*, 112*b*; 112*b*, 112*c*; and 112*c*, 112*d*. The substantially cylindrical recesses 125 are machined to a predetermined bore diameter and depth and the spacers 115*a*, 115*b* and 115*c* are made to a predetermined thickness that is less than the depth of the cylindrical recesses 125 and to a diameter that is greater than the bore diameter of the respective part cylindrical recess 125 into which it is fitted in use so as to produce a desired interference fit when the spacers 115*a*, 115*b* and 115*c* are pressed into position.

Figure 10:
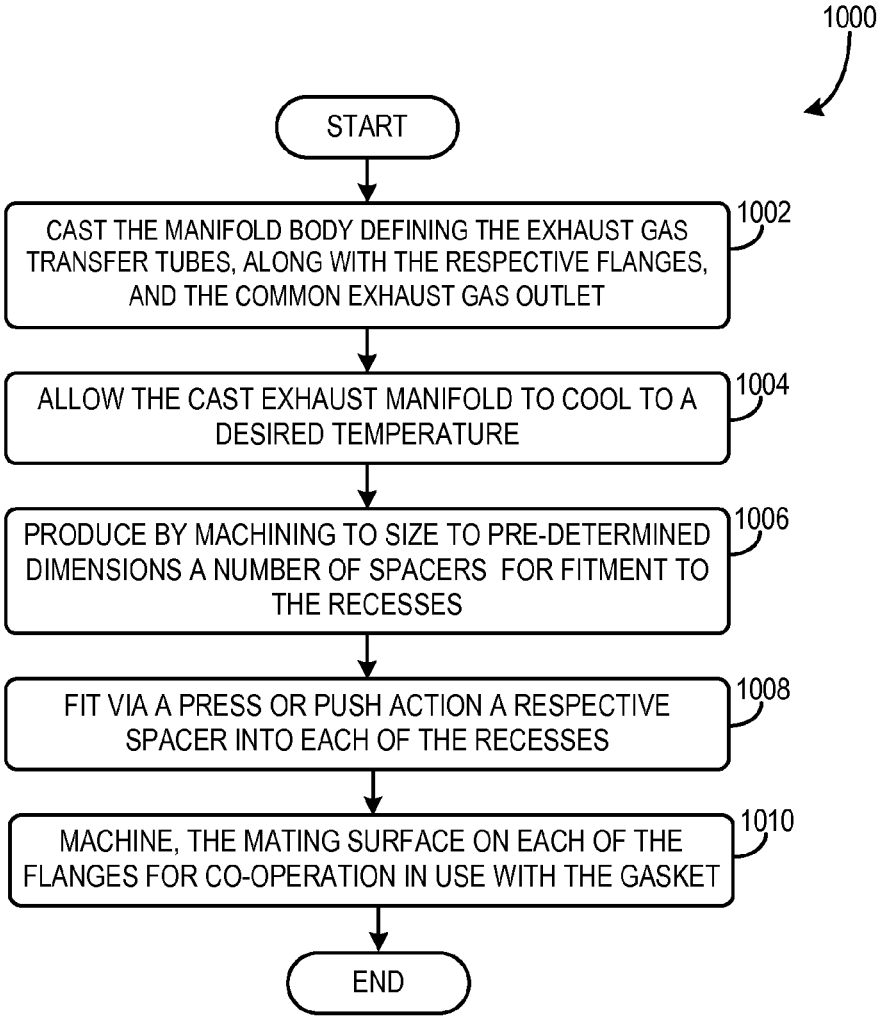
FIGS. 10 and 11 show methods for manufacture of exhaust manifolds.

A method 1000 for manufacturing an exhaust manifold is shown in FIG. 10. The method may be used to manufacture the exhaust manifold 111, shown in FIG. 3A-3C or may be used to manufacture another suitable exhaust manifold such as exhaust manifold 211, shown in FIGS. 4A-4C).

At 1002 the method includes casting the manifold body defining the exhaust gas transfer tubes (e.g., transfer tubes 113*a*, 113*b*, 113*c* and 113*d* shown in FIG. 3A) along with the respective flanges (e.g., flanges 112*a*, 112*b*, 112*c* and 112*d* shown in FIG. 3A), and the common exhaust gas outlet (e.g., common exhaust gas outlet 116 shown in FIG. 3A). Next at 1002 the method includes allowing the cast exhaust manifold (e.g., exhaust manifold 111 shown in FIG. 3A) to cool to a desired (e.g., ambient) temperature.

Next at 1004 the method includes forming by machining to pre-determined dimensions the recesses (e.g., recesses 125 shown in FIG. 3B). In some examples, the recesses may be substantially cylindrical but could be another shape, between adjacent flanges (e.g., flanges 112*a*, 112*b*; 112*b*, 112*c*; and 112*c*, 112*d* shown in FIG. 3A).

The method further includes at 1006 producing by machining to size to pre-determined dimensions a number of spacers (e.g., spacers 115*a*, 115*b* and 115*c* shown in FIG. 3A) for fitment to the recesses (e.g., recesses 125 shown in FIG. 3B) The method includes at 1008 fitting via a press or push action a respective spacer (e.g., spacers 115*a*, 115*b*, 115*c* shown in FIG. 3A) into each of the recesses (e.g., recesses 125 shown in FIG. 3B).

The method further includes at 1010 machining, the mating surface on each of the flanges (e.g., flanges 112*a*, 112*b*, 112*c*, 112*d* shown in FIG. 3B) for co-operation in use with the gasket (e.g., gasket 119 shown in FIG. 3C). Alternatively, the mating surfaces may be machined prior to fitment of the spacers (e.g., spacers 115*a*, 115*b* and 115*c* shown in FIG. 3B) into the substantially cylindrical recesses (e.g., recesses 125 shown in FIG. 3B.

Returning to FIGS. 3A-3C, the gaps 126 between the flanges 112*a*, 112*b*, 112*c*, 112*d* may be produced as part of the casting process or may be produced after casting by machining. That is to say, each of the exhaust gas transfer tubes 113*a*, 113*b*, 113*c* and 113*d* has a respective flange 112*a*, 112*b*, 112*c*, 112*d* for securing the exhaust manifold 111 to the engine 10 and each space or recess 125 is formed partly in each of the individual flanges 112*a*, 112*b*, 112*c*, 112*d* of adjacent exhaust gas transfer tubes 113*a*, 113*b*, 113*c* and 113*d*. The individual flanges 112*a*, 112*b*, 112*c*, 112*d* are formed either as part of the casting process that is to say the gaps are produced as part of the process or the individual flanges 112*a*, 112*b*, 112*c*, 112*d* are formed by casting a single flange as part of the manifold body and machining the gaps 126 in the single flange between adjacent exhaust gas transfer tubes 113*a*, 113*b*, 113*c* and 113*d* to produce the individual flanges 112*a*, 112*b*, 112*c*, 112*d*. It will be appreciated that the manufacturing techniques discussed above with regard to FIGS. 3A-3C may be incorporated into method 1000, if desired.

Figure 4A:
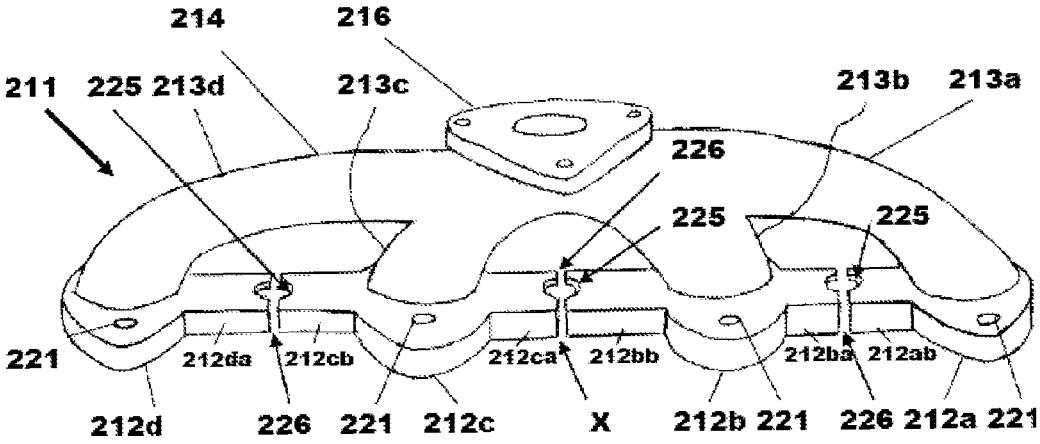
FIG. 4A is a pictorial view of a second example exhaust manifold.
Figure 4B:
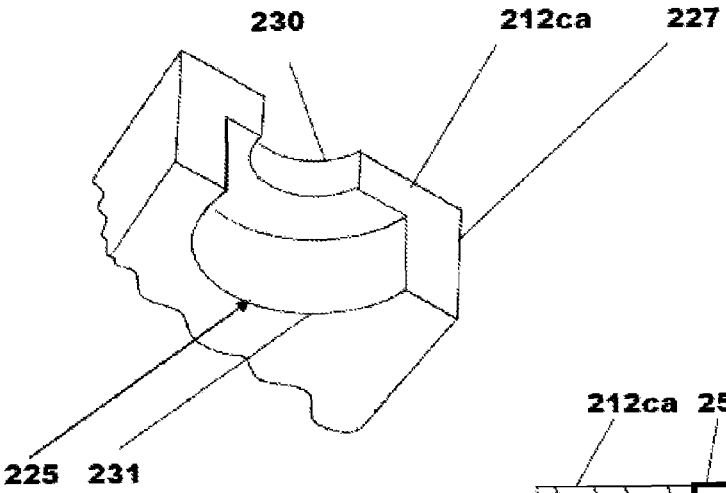
FIG. 4B is an enlarged view in the direction of arrow 'X' on FIG. 4A showing one half of a substantially cylindrical recess or space.
Figure 4C:
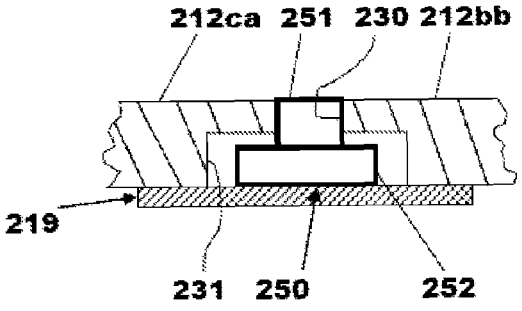
FIG. 4C Is a scrap cross-section through two tongues forming part of the exhaust manifold shown in FIG. 4A showing a top hat spacer in position when the exhaust manifold is cold.

Referring now to FIGS. 4A to 4C there is shown a second example exhaust manifold 211 that is similar in some respects to the exhaust manifold previously described with respect to FIGS. 3A to 3C and which may be manufactured using a similar method. It will be appreciated that the exhaust manifold 211 may be the exhaust manifold 11, shown in FIG. 1. The primary difference between the exhaust manifold shown in FIGS. 4A-4C and FIGS. 3A-3C is that in the case of the second example exhaust manifold 211 there is no distinct chamber to collect the exhaust gases, the collection means 214 is formed by the two outer exhaust gas transfer tubes 213*a* and 213*d* with which the two inner exhaust transfer tubes 213*b* and 213*c* merge.

The exhaust manifold 211 therefore, as before, includes a cast body defining four exhaust gas transfer tubes 213*a*, 213*b*, 213*c* and 213*d* and a common exhaust gas outlet 216 and a collection means where the exhaust gases from all of the exhaust gas transfer tubes 213*a*, 213*b*, 213*c* and 213*d* are combined or merged so as to flow out through the common exhaust gas outlet 216.

Each of the exhaust gas transfer tubes 213*a*, 213*b*, 213*c* and 213*d* has a respective flange 212*a*, 212*b*, 212*c* and 212*d* for securing the exhaust manifold 211 in use to a cylinder head (not shown) of an engine, such as the engine 10 shown in FIG. 1, by means of threaded fasteners (not shown) which extend through holes 221 formed in the flanges 212*a*, 212*b*, 212*c*, 212*d*. A gasket (not shown) is interposed in use between the cylinder head and the flanges 212*a*, 212*b*, 212*c* and 212*d* to provide a gas tight seal. Each of the flanges 212*a*, 212*b*, 212*c* and 212*d* has a machined mating surface for co-operation with the gasket.

Each of the flanges 212*a*, 212*b*, 212*c* and 212*d* has a tongue portion 212*ab*, 212*ba*, 212*bb*, 212*ca*, 212*cb*, 212*da* extending therefrom towards the tongue portion 212*ab*, 212*ba*, 212*bb*, 212*ca*, 212*cb*, 212*da* on the adjacent flange 212*a*, 212*b*, 212*c*, 212*d*.

A gap 226 is present between each pair of adjacent tongues 212*ab*, 212*ba*; 212*bb*, 212*ca*; and 212*cb*, 212*da*. A substantially cylindrical recess 225 is formed in between each pair of adjacent tongues 212*ab*, 212*ba*; 212*bb*, 212*ca*; and 212*cb*, 212*da* to form a space used to accommodate a round disc spacer.

The shape and configuration of one half of one of the recesses 225 is shown in greater detail in FIG. 4B from which it can be seen that each recess 225 includes of a small diameter bore 230 and an accurately sized large diameter bore 231 one half of which is formed in each of the adjacent tongues 212*ca* and 212*bb* by a machining process. The other substantially cylindrical recesses 225 are of the same shape and configuration and are formed in a like manner.

FIG. 4B also shows an end face 227 of the tongue 212*ca* which in use defines one side of the gap 226 between the tongue 212*ca* and the tongue 212*bb*. It will be appreciated that the tongue 212*bb* would have a similar end face as would all of the other tongues 212*da*, 212*cb*, 212*ba* and 212*ab*.

In use the round disc spacer is fitted in each of the spaces 225 so as to fit with interference in the accurately formed large diameter bore 231 when the exhaust manifold 211 is cold. Note that the large diameter bore 231 is machined into a mating surface of each of the flanges 212*a*, 212*b*, 212*c* and 212*d* so that when the flanges 212*a*, 212*b*, 212*c* and 212*d* are fastened to the cylinder head the spacers 215*a*, 215*b* and 215*c* will be held captive between the flanges 212*a*, 212*b*, 212*c* and 212*d* and the gasket.

Figure 6:
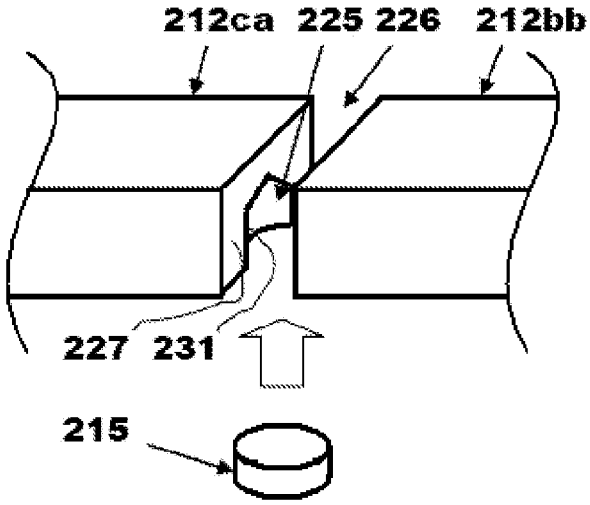
FIG. 6 is a view similar to FIG. 4B but showing an alternative form of recess and a plain disc spacer prior to insertion in the recess.

In this case the diameter of the spacer is machined to a pre-determined diameter that is greater than a pre-determined diameter of the large diameter bore 231 by an amount sufficient to produce the desired degree of interference fit when the spacer is in place and the exhaust manifold is cold. The small diameter bore 230 is used only as a pilot hole for use in machining the large diameter bore 231. In FIG. 6 an alternative arrangement is shown in which the large diameter bore 231 is produced using a simple drilling process rather than a counter boring process as used to produce the large diameter bore 231 shown in FIGS. 4A and 4B. A pilot hole is not used in this case and so no small diameter bore is present. The same reference numerals are used in FIG. 6 as those used in FIGS. 4A and 4B with the same meaning.

FIG. 4C shows an alternative spacer 250 which is of a top hat shape having a small diameter stem 251 and a larger diameter end flange 252. In this case the small diameter stem 251 is the critical dimension as the end flange 252 is provided to hold the spacer 250 captive. Therefore in this case the stem 251 is machined to a pre-determined diameter that is greater than a pre-determined diameter of the small diameter bore 230 by an amount sufficient to produce the desired degree of interference fit when the spacer 250 is in place and the exhaust manifold 211 is cold.

With such an arrangement only the small diameter bore 230 needs to be accurately machined, the large diameter bore 231 can be in an 'as cast' condition and is larger than the diameter of the end flange 252 because the end flange is only provided to hold the spacer 250 captive.

Figure 7:
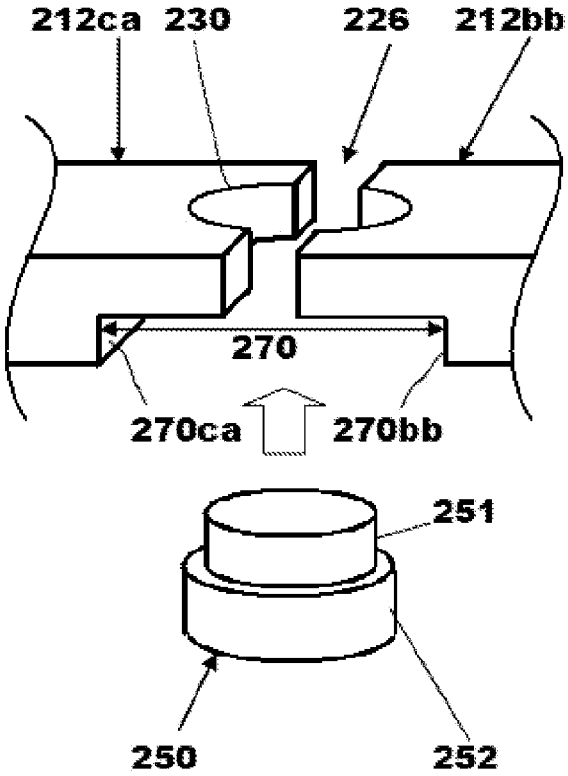
FIG. 7 is a view similar to FIG. 4B but showing an alternative form of recess and a top hat disc spacer as shown in FIG. 4C prior to insertion in the recess.
Figure 8:
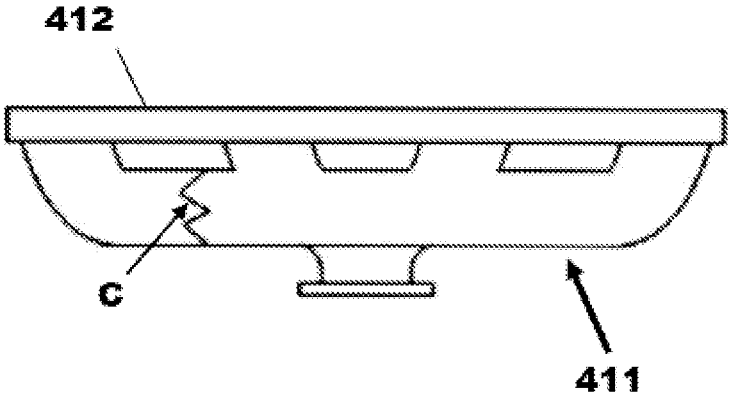
Prior Art Fig.8
FIG. 8 is a plan view of a prior art exhaust manifold having a one piece flange.
Figure 9A:
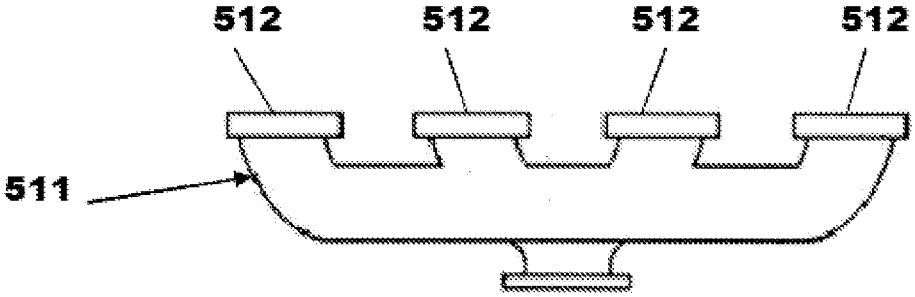
Prior Art Fig.9A
FIG. 9A is a plan view of a prior art exhaust manifold having individual flanges showing the exhaust manifold in an non-deformed state.
Figure 9B:
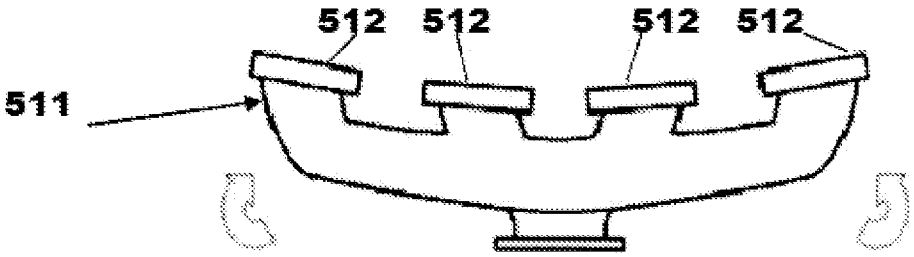
Prior Art Fig.9B
FIG. 9B is a view of the prior art exhaust manifold shown in FIG. 9A but showing the exhaust manifold in a deformed state.

It will be appreciated that if a top hat shape spacer 250 is used then the large diameter bore could as shown in FIG. 7 be replaced by a linear recess 270 extending between each pair of the tongues 212*ab*, 212*ba*; 212*bb*, 212*ca*; and 212*cb*, 212*da* of which the tongues 212*ca* and 212*bb* are shown in FIG. 7. The linear recess 270 is defined between two end faces 270*ca* and 270*bb* formed on the tongues 212*ca* and 212*bb* respectively. As before a gap 226 is present between the pair of tongues 212*ca* and 212*bb* and an accurately formed cylindrical bore 230 is provided for cooperation with the small diameter stem 251 of the top hat spacer 250. As before, the larger diameter end flange 252 retains the top hat spacer 250 in position during use because the end flange 252 is unable to pass through the cylindrical bore 230. It will be appreciated that the larger diameter end flange need not be cylindrical it could for example be square or oblong in shape.

Referring now to FIGS. 5A to 5C there is shown a third example exhaust manifold 311. It will be appreciated that the exhaust manifold 311 may be the exhaust manifold 11, shown in FIG. 1.

The exhaust manifold 311 includes a cast body defining four exhaust gas transfer tubes 313*a*, 313*b*, 313*c* and 313*d* and a common exhaust gas outlet 316 and a collection means in the form of a chamber 314 where the exhaust gases from all of the exhaust gas transfer tubes 313*a*, 313*b*, 313*c* and 313*d* are combined or merged so as to flow out through the common exhaust gas outlet 316.

Each of the exhaust gas transfer tubes 313*a*, 313*b*, 313*c* and 313*d* has a respective flange 312*a*, 312*b*, 312*c* and 312*d* for securing the exhaust manifold 311 in use to a cylinder head 310B of an engine, such as the engine 10 shown in FIG. 1, by means of threaded fasteners (not shown) which extend through holes 321 formed in the flanges 312*a*, 312*b*, 312*c*, 312*d*. A gasket 319 is interposed between the exhaust cylinder head 310B and the flanges 312*a*, 312*b*, 312*c* and 312*d* to provide a gas tight seal. Each of the flanges 312*a*, 312*b*, 312*c* and 312*d* has a machined mating surface for co-operation with the gasket 319.

An oblong shaped disc spacer 315*a*, 315*b* and 315*c* is fitted between adjacent flanges 312*a*, 312*b*, 312*c* and 312*d* so as to produce an interference fit with the adjacent flanges 312*a*, 312*b*, 312*c* and 312*d* when the exhaust manifold 311 is cold.

The spacer 315*a* is fitted in a space or gap 326*a* formed between opposing faces 'F' of the flanges 312*a* and 312*b*; the spacer 315*b* is fitted in a space or gap 326*b* formed between opposing faces 'F' of the flanges 312*b* and 312*c*; and the spacer 315*c* is fitted in a space or gap 326*c* formed between opposing faces 'F' of the flanges 312*c* and 312*d*. Each of the faces 'F' is machined to produce a predetermined distance between the two opposing faces 'F' and the spacers 315*a*, 315*b* and 315*c* are machined to a predetermined width that is greater than the distance between the two opposing faces 'F' into which it is fitted in use so as to produce the a desired interference fit when the spacers 315*a*, 315*b* and 315*c* are pressed into position. In this example the spacers 315*a*, 315*b* and 315*c* are held captive by the gasket 319 to which they are fastened by welding.

Figure 11:
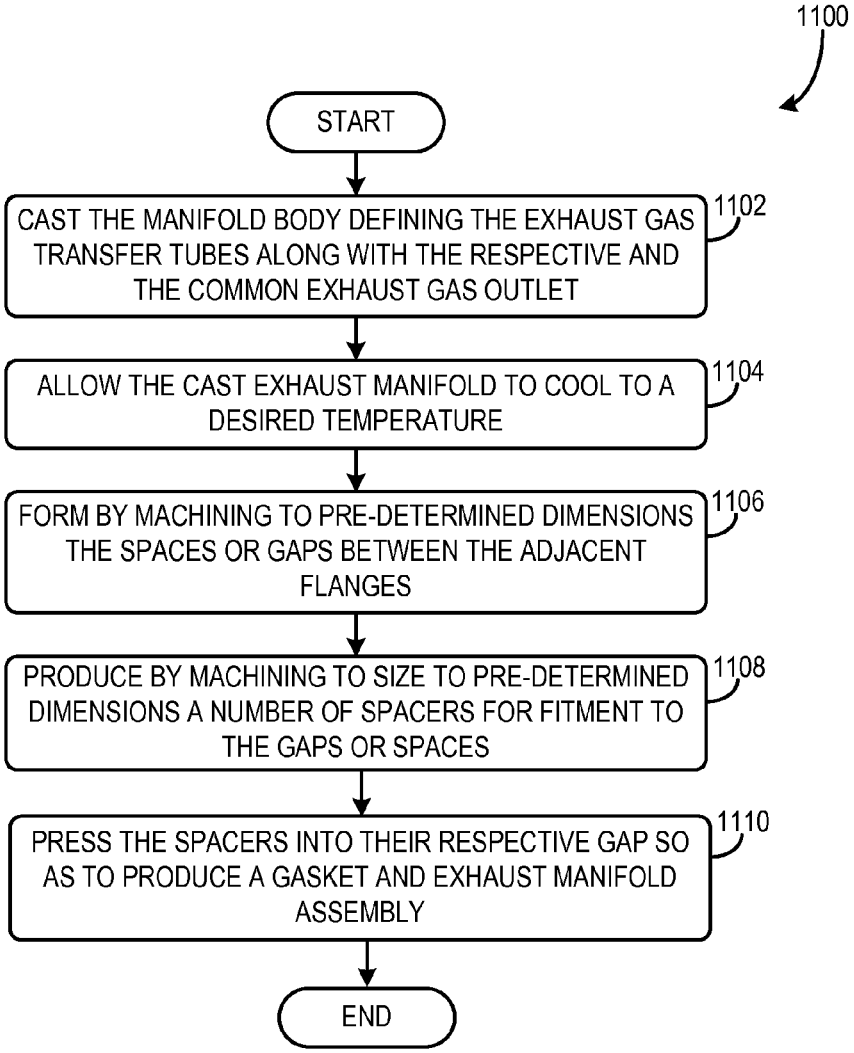

A method 1100 for manufacturing an exhaust manifold is shown in FIG. 11. The method may be used to manufacture the exhaust manifold 111, shown in FIG. 5A-5C or may be used to manufacture another suitable exhaust manifold.

At 1102 the method includes casting the manifold body defining the exhaust gas transfer tubes (e.g., transfer tubes 313*a*, 313*b*, 313*c* and 313*d* shown in FIG. 5A) along with the respective flanges (e.g., flanges 312*a*, 312*b*, 312*c* and 312*d* shown in FIG. 5A) and the common exhaust gas outlet (e.g., common exhaust gas outlet 316 shown in FIG. 5A). Next at 1104 the method includes allowing the cast exhaust manifold (e.g., exhaust manifold 311 shown in FIG. 3A) to a desired (e.g., ambient) temperature. At 1106 the method includes forming by machining to pre-determined dimensions the spaces or gaps (e.g., spaces or gaps 326*a*, 326*b* and 326*c* shown in FIG. 5C) between the adjacent flanges (e.g., flanges 312*a*, 312*b*; 312*b*, 312*c*; and 312*c*, 312*d* shown in FIG. 5A).

The method further includes at 1108 producing by machining to size to pre-determined dimensions a number of spacers (e.g., spacers 315*a*, 315*b* and 315*c* shown in FIG. 5A) for fitment to the gaps or spaces (e.g., gaps or spaces 326*a*, 326*b* and 326*c* shown in FIG. 5C). The spacers (e.g., spacers 315*a*, 315*b* and 315*c* shown in FIG. 5A) may be welded to the gasket (e.g., gasket 319 shown in FIG. 5A) before machining or may be machined after they have been welded to the gasket.

The method further at 1110 pressing the spacers (e.g., spacers 315*a*, 315*b*, 315*c* shown in FIG. 5A) into their respective gap (e.g., gaps 326*a*, 326*b* and 326*c* shown in FIG. 5C) so as to produce a gasket and exhaust manifold assembly.

Returning to FIGS. 5A-5C, it will be appreciated that the mating surfaces of the flanges 312*a*, 312*b*, 312*c* and 312*d* are in this case machined prior to fitment of the spacers 315*a*, 315*b* and 315*c* into the gaps 326*a*, 326*b* and 326*c*.

Therefore in summary, the exhaust manifold (e.g., cast exhaust manifold) is fastened to the engine by a number of independent flanges between each pair of which a spacer is located so as to produce an interference fit when the exhaust manifold is at or near an ambient temperature. The use of independent flanges allow the exhaust manifold to expand when heated without creating high levels of internal stress and the spacers reduce (e.g., prevent) undue distortion of the flanges when the exhaust manifold cools. Although the exhaust manifold has been described with reference to use on a four cylinder engine it will be appreciated that it could be applied to other cast exhaust manifold having two or more exhaust gas transfer tubes connected to an engine. It will be appreciated that the spacers and recesses are not limited to the shapes described above and that other shapes could be used.

FIGS. 1-11 provide for a method of manufacturing an exhaust manifold for an engine, the method comprises casting a manifold body defining at least two exhaust gas transfer tubes and a common exhaust gas outlet, allowing the manifold body to cool to a desired temperature, and forming to predetermined dimensions a space between adjacent exhaust gas transfer tubes. The method further comprises producing to predetermined dimensions a number of spacers for fitment to the space and fitting a respective spacer into each of the spaces producing an interference fit between the spacers and the flanges when the exhaust manifold is cold.

FIGS. 1-11 further provide for a method where each of the exhaust gas transfer tubes has a respective flange for securing the exhaust manifold to the engine and each space is formed partly in each of the individual flanges of adjacent exhaust gas transfer tubes. FIGS. 1-11 further provide for a method where the individual flanges are formed as part of the casting process. FIGS. 1-11 further provide for a method where the individual flanges are formed by casting a single flange as part of the manifold body and machining gaps in the single flange between adjacent exhaust gas transfer tubes to produce the individual flanges.

FIGS. 1-11 also provide for an exhaust manifold in an engine of a motor vehicle comprising a cast body including two exhaust gas transfer tubes and a common exhaust gas outlet, each of the exhaust gas transfer tubes having a respective flange securing the exhaust manifold to the engine, where a spacer is fitted between adjacent flanges producing an interference fit with the adjacent flanges when the exhaust manifold is cold, each of the exhaust gas transfer tube each in fluidic communication with a separate cylinder in the engine.

FIGS. 1-11 further provide for an exhaust manifold where each spacer is fixed in position between the adjacent flanges. FIGS. 1-11 further provide for an exhaust manifold where a gap is defined between adjacent flanges and each spacer is fixed in position projecting into the gap defined between adjacent flanges. FIGS. 1-11 further provide for an exhaust manifold where each of the flanges has a mating surface for sealing attachment to the engine, a gasket is interposed between each mating surface and the engine and each spacer is attached to the gasket so as to hold the spacer in a fixed position.

Furthermore, it will be appreciated by those skilled in the art that although the invention has been described by way of example with reference to one or more embodiments it is not limited to the disclosed embodiments and that alternative embodiments could be constructed without departing from the scope of the invention as defined by the appended claims.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust manifold in an engine comprising:

a cast body defining at least two exhaust gas transfer tubes and a common exhaust gas outlet, each of the exhaust gas transfer tubes having a respective flange securing the exhaust manifold to the engine, where a spacer is fitted into a gap between adjacent flanges producing an interference fit with the adjacent flanges when the exhaust manifold is cold.

2. The exhaust manifold of claim 1, where each spacer is held captive in position between the adjacent flanges via an interference with the exhaust manifold.

3. The exhaust manifold of claim 1, where each of the flanges has a mating surface for sealing attachment to the engine and each of the mating surfaces has part of a recess formed in it into which the spacer is fitted so as to hold the spacer captive.

4. The exhaust manifold of claim 1, where the gap is defined between adjacent flanges and each spacer is held captive so as to project into the gap defined between adjacent flanges, the spacer having predetermined dimensions prior to insertion in the gap.

5. The exhaust manifold of claim 4, where each of the flanges has a mating surface for sealing attachment to the engine, a gasket is interposed between each mating surface and the engine and each spacer is attached to the gasket so as to hold the spacer captive.

6. The exhaust manifold of claim 1, where the exhaust manifold is sealingly secured to a cylinder head in the engine, the cylinder head transferring exhaust gases from the engine to an exhaust system and included in the engine.

7. The exhaust manifold of claim 1, where the exhaust system is connected to an outlet of the exhaust manifold, the exhaust system transporting exhaust gases from the engine to atmosphere.

8. The exhaust manifold of claim 1, where the engine is included in a motor vehicle.

9. An exhaust manifold in an engine of a motor vehicle comprising:

a cast body including two exhaust gas transfer tubes and a common exhaust gas outlet, each of the exhaust gas transfer tubes having a respective flange securing the exhaust manifold to the engine, where a spacer is fitted into a gap between adjacent flanges producing an interference fit with the adjacent flanges when the exhaust manifold is cold, each of the exhaust gas transfer tube each in fluidic communication with a separate cylinder in the engine.

10. The exhaust manifold of claim 9, where each spacer is fixed in position between the adjacent flanges.

11. The exhaust manifold of claim 9, where the gap is defined between adjacent flanges and each spacer is fixed in position projecting into the gap defined between adjacent flanges.

12. The exhaust manifold of claim 11, where each of the flanges has a mating surface for sealing attachment to the engine, a gasket is interposed between each mating surface and the engine and each spacer is attached to the gasket so as to hold the spacer in a fixed position.

* * * * *